US008341867B2

(12) United States Patent
Criswell

(10) Patent No.: US 8,341,867 B2
(45) Date of Patent: Jan. 1, 2013

(54) CHEEK SUPPORT APPARATUS

(76) Inventor: Curtis Daniel Criswell, Pocatello, ID (US)

( * ) Notice: Subject to any disclaimer, the term of this patent is extended or adjusted under 35 U.S.C. 154(b) by 96 days.

(21) Appl. No.: 12/943,915

(22) Filed: Nov. 10, 2010

(65) Prior Publication Data

US 2012/0110884 A1 May 10, 2012

(51) Int. Cl.
*F41C 23/14* (2006.01)

(52) U.S. Cl. ..... 42/73

(58) Field of Classification Search ..... 42/71.01, 42/72, 73, 74; D22/108, 111
See application file for complete search history.

(56) References Cited

U.S. PATENT DOCUMENTS 616,424 A * 12/1898 Rowley ..... 42/71.01
2,282,428 A * 5/1942 Rigandi ..... 42/74
3,710,496 A * 1/1973 Packmayr et al. ..... 42/71.01
4,120,108 A * 10/1978 Vickers et al. ..... 42/74
4,203,244 A * 5/1980 Hickman ..... 42/73
5,265,365 A * 11/1993 Finn ..... 42/74
5,771,622 A * 6/1998 Koziuk et al. ..... 42/74
5,970,642 A * 10/1999 Martin ..... 42/73
2007/0101631 A1* 5/2007 Bentley ..... 42/74
2010/0180484 A1* 7/2010 Aalto et al. ..... 42/73
2011/0016764 A1* 1/2011 Cales ..... 42/90

FOREIGN PATENT DOCUMENTS

GB 2185557 A * 7/1987

* cited by examiner

*Primary Examiner* — Bret Hayes
(74) *Attorney, Agent, or Firm* — Ash Tankha; Lipton, Weinberger & Husick

(57) ABSTRACT

A cheek support apparatus comprising a generally inverted U-shaped shell member, a base member, and a cheek supporting member is provided for a firearm. The shell member made of a form fitting material, for example, a thermoplastic material, is selectively configured with different coefficients of friction to enable rigid contact of the shell member to a stock of the firearm. The shell member comprising an inner frictional surface defines an opening for accommodating the stock of the firearm. The base member is rigidly attached to a closed upper end of the shell member. In an embodiment, one or more shim members are removably attached on the base member for adjustably positioning the cheek supporting member on the base member. The cheek supporting member is removably attached on one or more of the shim members or the base member for supporting a user's cheek, for example, during recoil of the firearm.

15 Claims, 11 Drawing Sheets

CHEEK SUPPORT APPARATUS

BACKGROUND

A conventional cheek piece used in firearms today is attached to a stock of a rifle, for example, using adhesives, straps, laces, hook and loop fasteners, threaded fasteners such as screws, bolts, etc. These modes of attachment have inherent drawbacks, for example, poor gripping contact between the cheek piece and the stock of the rifle, loosening out of the cheek piece from the stock of the rifle, etc., during firing due to vibrations and other factors. The loosening out of the cheek piece from the stock during firing distracts the user, which results in the user missing a target. The loosening out of the cheek piece from the stock interferes with the rifle's mechanical operation. Moreover, the stock may need to be modified for attaching conventional cheek pieces, which reduces the value of the rifle.

In order to shoot accurately, a user must hold the rifle the same way every time and therefore needs to hold the user's eye at a particular height that allows the user to see through the center of the riflescope every time the user fires the rifle. In order to control the recoil of the rifle, the user must rest a cheek on an area of the stock of the rifle called a comb. To simultaneously control recoil and to obtain proper cheek support, the rifle's comb must be positioned at the correct height. Most often, the height of the comb required to control recoil during firing and to see through the riflescope is significantly higher than the existing rifle's comb height.

Moreover, the barrel of a rifle must be cleaned after firing. The user typically cleans the barrel of the rifle from a breech or a chamber end of the barrel using a cleaning rod. The need to accommodate the cleaning rod limits the height of the rifle's comb. If the comb is too high, the cleaning rod cannot be inserted into the breech end of the barrel.

Since the height of the comb is limited by the need to clean the rifle but the user needs the rifle's comb to be of a specific height that is higher than that allowed by the rifle's comb, there is a need for a cheek support apparatus that can be adjustably positioned to meet the height requirements.

Furthermore, loading and unloading of a conventional cheek piece on the rifle's stock is time consuming, which proves to be a major drawback in times of emergencies. Frequent installation and removal of the conventional cheek piece leads to deterioration in the surface finish of the rifle's stock, which further reduces the value of the rifle.

Hence, there is a long felt but unresolved need for a portable, easily installable and uninstallable cheek support apparatus that grips the stock of any firearm firmly, and that can be adjustably positioned to meet height requirements during cleaning and firing of the firearm.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The cheek support apparatus disclosed herein addresses the above stated need for a portable, easily installable and uninstallable apparatus that grips a stock of any firearm firmly and that can be adjustably positioned to meet height requirements during cleaning and firing of the firearm. The cheek support apparatus disclosed herein comprises a generally inverted U-shaped shell member having a closed upper end and an open lower end, a base member, and a cheek supporting member.

The generally inverted U-shaped shell member is made of a form fitting material, for example, a thermoplastic material, configured to conform to contours of a stock of a firearm. The generally inverted U-shaped shell member is herein referred to as a "shell member". The shell member comprises an inner frictional surface. The inner frictional surface of the shell member defines an opening between the closed upper end and the open lower end of the shell member for accommodating the stock of the firearm. The inner frictional surface is selectively configured with different coefficients of friction to enable a rigid contact of the shell member to the stock of the firearm. The inner frictional surface of the shell member rigidly contacts the stock of the firearm and restricts movement of the shell member on the stock of the firearm.

In an embodiment, the inner frictional surface comprises a first section and second sections. The first section proximally extends from the open lower end of the shell member on opposing sides of the shell member towards the closed upper end of the shell member. The first section is made of a high friction compressible material, for example, rubber, polyurethane foam, etc., which maximizes resistance to the cheek support apparatus' forward movement relative to the stock of the firearm during recoil of the firearm. Each of the second sections extends from the open lower end on the opposing sides of the shell member towards the first section. Each of the second sections is made of a low friction material, for example, a soft, wear-resistant textile material. The low friction material minimizes wear of the cheek support apparatus on the stock due to abrasion and makes the installation of the cheek support apparatus on the stock easier.

The base member is rigidly attached on the closed upper end of the shell member. In an embodiment, the cheek support apparatus disclosed herein further comprises one or more shim members removably attached on the base member for adjustably positioning the cheek supporting member on the base member. In an embodiment, each of the shim members comprises a slot and a key member. The slot of each of the shim members longitudinally extends along a lower surface of each of the shim members. The key member of each of the shim members extends along an upper surface of each of the shim members. The slot of one of the shim members is configured to engageably connect to the base member. The key member of one of the shim members is configured to engageably connect to the slot of another one of the shim members. The key member of one of the shim members is also configured to engageably connect to a slot configured on the cheek supporting member. The slot configured on the cheek supporting member longitudinally extends along a base of the cheek supporting member.

In an embodiment, the base member is configured as a key member that engageably connects to the slot of one of the shim members or the slot configured on the cheek supporting member. If the user achieves a comfortable height without the shim members, the cheek supporting member can be directly connected to the base member. The cheek supporting member is removably attached on one of the shim members or directly on the base member for supporting a user's cheek during recoil of the firearm. The slot of the cheek supporting member is configured to engageably connect to the key member of one of the shim members or to the base member. In another embodiment, one or more auxiliary elements are detachably attached on the cheek support apparatus for accommodating multiple items associated with the firearm.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific components and methods disclosed herein.

DETAILED DESCRIPTION OF THE INVENTION

Figure 1:
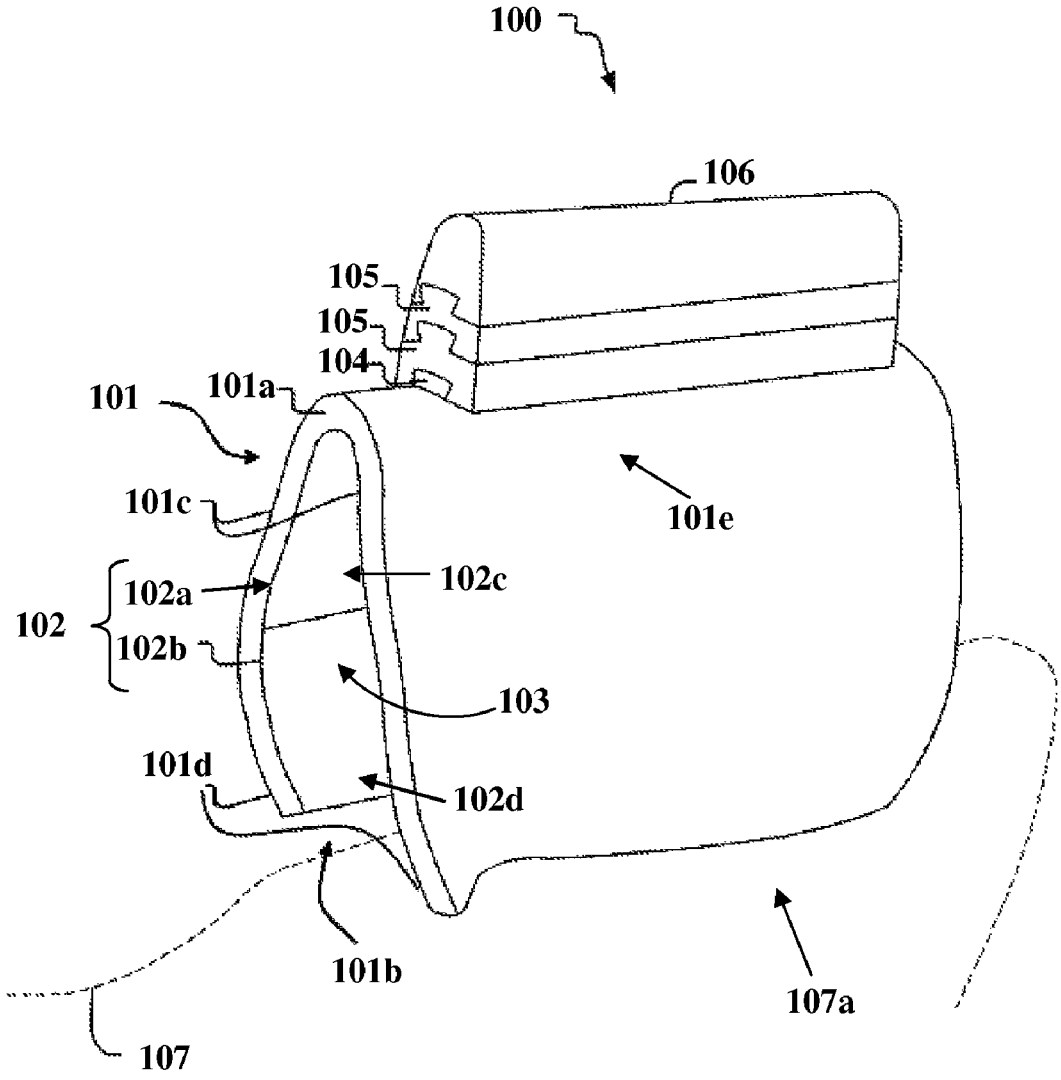
FIG. 1 exemplarily illustrates a perspective view of a cheek support apparatus for a firearm.

FIG. 1 exemplarily illustrates a perspective view of a cheek support apparatus 100 for a firearm 107. As exemplarily illustrated in FIG. 1, the cheek support apparatus 100 disclosed herein comprises a generally inverted U-shaped shell member 101 having a closed upper end 101*a* and an open lower end 101*b*, a base member 104, one or more shim members 105, and a cheek supporting member 106. The generally inverted U-shaped shell member 101 is herein referred to as a "shell member". The shell member 101 is made of a form fitting material configured to conform to contours of a stock 107*a* of a firearm 107. As used herein, the term "firearm" refers to any device used for projecting one or more projectiles at a high velocity. The firearm 107 is, for example, a rifle, a shotgun, a carbine, a crossbow, etc. The form fitting material of the shell member 101 is a flexible and springy material, for example, a thermoplastic material manufactured by Kydex® LLC, etc. The shell member 101 is shaped to conform to each of the contours of the stock 107*a* of the firearm 107. The flexibility or springiness of the shell member 101 allows the lower edges 101*d* of the shell member 101 to move apart far enough to allow installation of the cheek support apparatus 100 on the stock 107*a* of the firearm 107. After the cheek support apparatus 100 is installed on the stock 107*a* of the firearm 107, the shape and the springiness of the material of the shell member 101 allows the shell member 101 to act as a spring clamp that rigidly clamps to the stock 107*a* of the firearm 107.

The shell member 101 comprises an inner frictional surface 102 that defines an opening 103 between the closed upper end 101*a* and the open lower end 101*b* of the shell member 101 for accommodating the stock 107*a* of the firearm 107. The inner frictional surface 102 is selectively configured with different coefficients of friction to enable rigid contact of the shell member 101 to the stock 107*a* of the firearm 107. The inner frictional surface 102 of the shell member 101 rigidly contacts the stock 107*a* of the firearm 107 and restricts movement of the shell member 101 on the stock 107*a* of the firearm 107.

The inner frictional surface 102 comprises a first section 102*a* and second sections 102*b*. The first section 102*a* proximally extends from the open lower end 101*b* on opposing sides 101*c* of the shell member 101 towards the closed upper end 101*a* of the shell member 101. For example, the first section 102*a* extends a short length away from the lower edges 101*d* of the shell member 101. The first section 102*a* of the inner frictional surface 102 is made of a high friction compressible material 102*c*, for example, rubber, polyurethane foam, etc. The high friction compressible material 102*c* of the first section 102*a* of the inner frictional surface 102 is compressed by a clamping force of the shell member 101. The compressibility of the high friction compressible material 102*c* allows the first section 102*a* to conform closely to the stock 107*a* of the firearm 107, thereby maximizing contact surface area of the shell member 101 to the stock 107*a* of the firearm 107. Each of the second sections 102*b* extends from the open lower end 101*b* on the opposing sides 101*c* of the shell member 101 towards the first section 102*a*. Each of the second sections 102*b* is made of a low friction material 102*d*, for example, a soft, wear-resistant textile material such JDC A902-2PT of JDC Coatings Inc., which is a high quality 1.0 mm black flocked fabric designed for demanding automotive interior anti-squeak applications. The low friction material 102*d* minimizes wear on the stock 107*a* due to abrasion. The low friction material 102*d* is used for efficient installation of the shell member 101 on the stock 107*a* of the firearm 107, as the stock 107*a* slides against the second sections 102*b* of the inner frictional surface 102 of the shell member 101. The outer surface 101*e* of the shell member 101 is rigid.

The base member 104 of the cheek support apparatus 100 is rigidly attached on the closed upper end 101*a* of the shell member 101. In an embodiment, one or more of the shim members 105 of the cheek support apparatus 100 are removably attached on the base member 104 for adjustably positioning the cheek supporting member 106 on the base member 104. The cheek supporting member 106 is removably attached on one of the shim members 105 or the base member 104 for supporting a user's cheek. If the user achieves a comfortable height without the shim members 105, the cheek supporting member 106 can be directly connected to the base member 104. The cheek support apparatus 100 disclosed herein supports the user's cheek during recoil of the firearm 107. The cheek support apparatus 100 can also be adjusted on the stock 107*a* of the firearm 107 for enabling the user to clean the firearm 107.

Figure 2A:
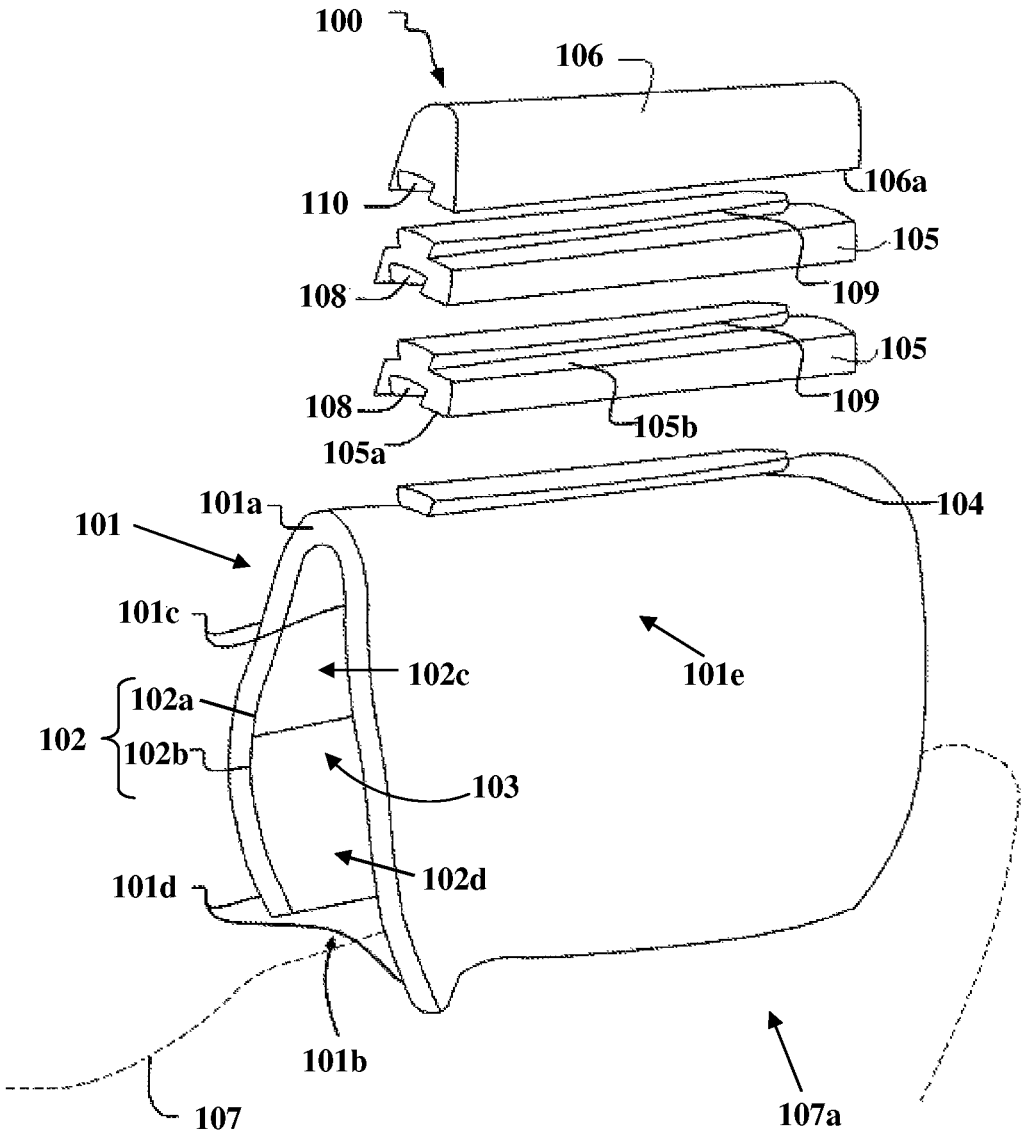
FIGS. 2A-2B exemplarily illustrate perspective exploded views of the cheek support apparatus.
Figure 2B:
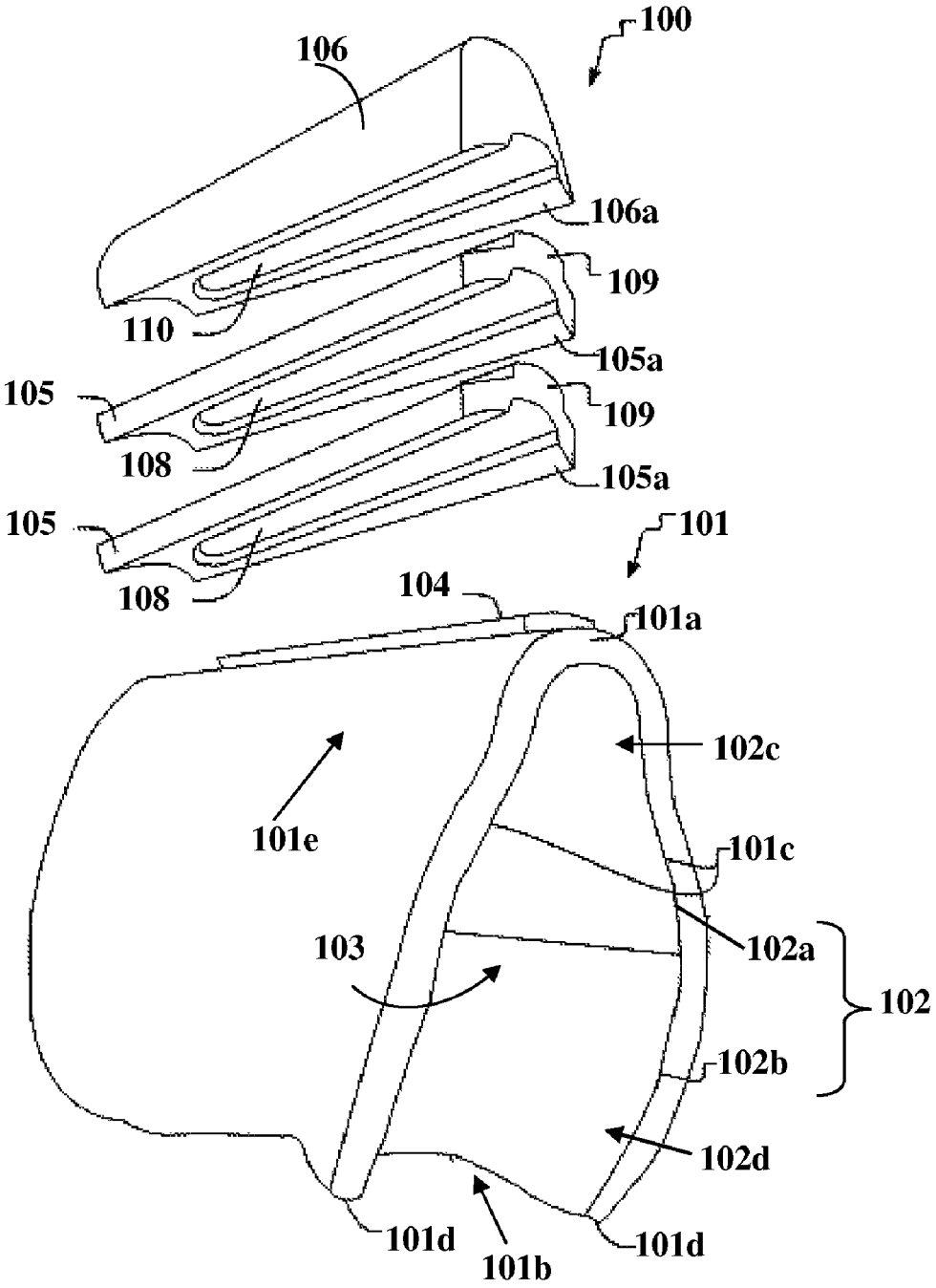

FIG. 2A-2B exemplarily illustrate perspective exploded views of the cheek support apparatus 100. The cheek support apparatus 100 disclosed herein comprises the shell member 101, the base member 104 rigidly attached on the closed upper end 101*a* of the shell member 101, one or more shim members 105, and the cheek supporting member 106 as disclosed in the detailed description of FIG. 1. Each of the shim members 105 are removably attached on the base member 104 for adjustably positioning the cheek supporting member 106 on the base member 104. As exemplarily illustrated in FIGS. 2A-2B and FIGS. 3-4, each shim member 105 comprises a slot 108 and a key member 109. The slot 108 longitudinally extends along a lower surface 105*a* of the shim member 105. The key member 109 extends along an upper surface 105*b* of the shim member 105. The slot 108 of one of the shim members 105 is configured to engageably connect to the base member 104. The rigidly attached base member 104 is configured as a key member that engageably connects to the slot 108 of one of the shim members 105, or a slot 110 configured on the cheek supporting member 106.

The key member 109 of each shim member 105 is configured to engageably connect to the slot 108 of another shim member 105. The key member 109 of each shim member 105 is also configured to engageably connect to the slot 110 configured on the cheek supporting member 106. The cheek supporting member 106 comprises a slot 110 longitudinally extending along a base 106*a* of the cheek supporting member 106. The slot 110 of the cheek supporting member 106 is configured to engageably connect to a key member 109 of a shim member 105 or the base member 104.

The slot 108 of each of the shim members 105 and the slot 110 of the cheek supporting member 106 are configured, for example, by shaping, milling, etc. The slot 108 of each of the shim members 105 and the slot 110 of the cheek supporting member 106 is, for example, a dovetail slot, a square slot, an inverted dovetail slot, etc. The key member 109 of each of the shim members 105 and the base member 104 is, for example, a tapered key, a square head key, a trapezoidal key, etc. For purposes of illustration, the detailed description refers to a slot 108 or 110 and a key member 109 used for engageably connecting a shim member 105 to the base member 104, a shim member 105 to another shim member 105, and a cheek supporting member 106 to a shim member 105 or the base member 104. However, the scope of the cheek support apparatus 100 disclosed herein is not limited to a slot 108 or 110 and a key member 109 but may be extended to include other forms of engageable connectors such as mating fasteners, complementing dovetails, mechanical attachments, screws, adhesives, etc., and other functionally equivalent structures and methods such as friction fitting.

In another embodiment, the shim members 105 and the cheek supporting member 106 are attached to the shell member 101 using fasteners, for example, clips, clamps, adhesives, mechanical fasteners, etc.

Figure 3:
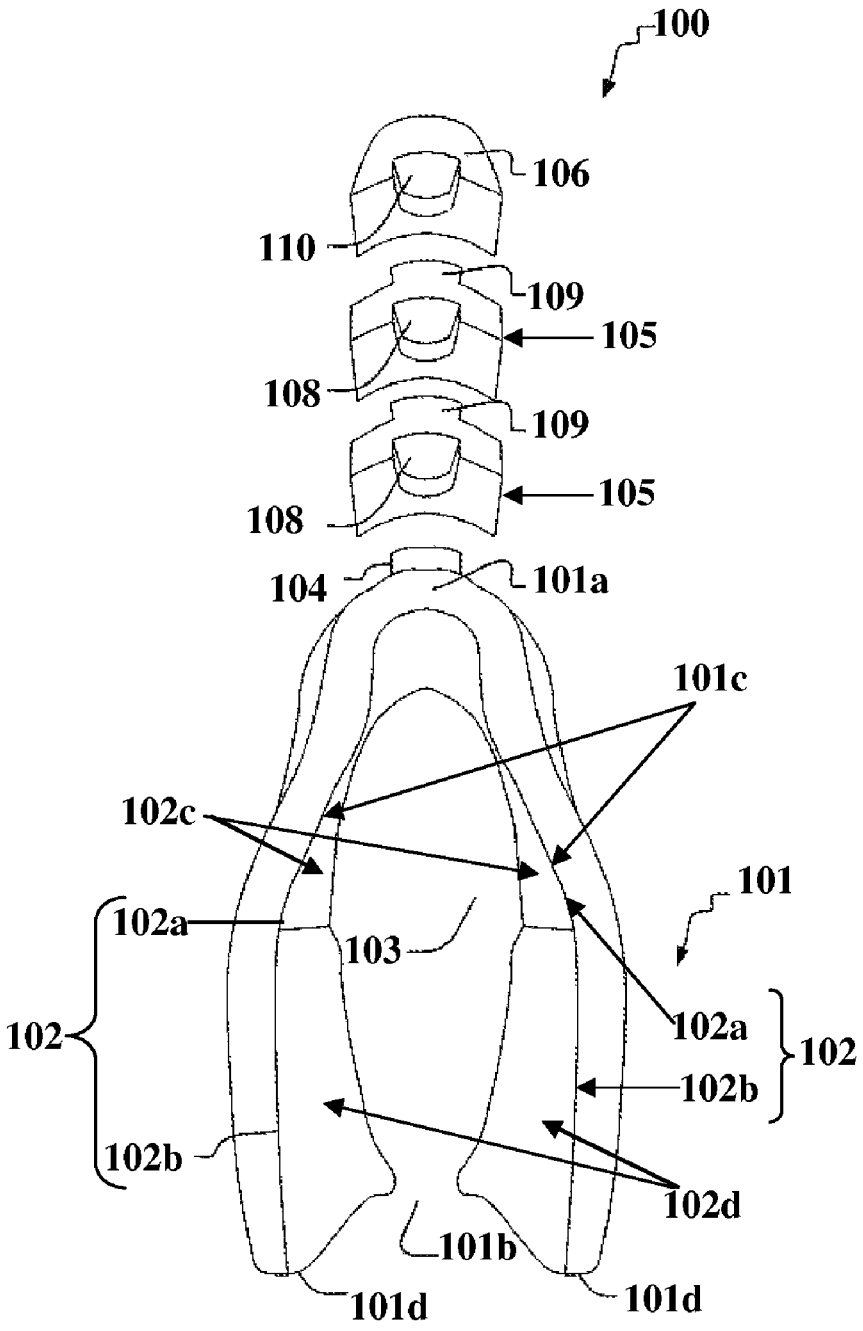
FIG. 3 exemplarily illustrates a front orthogonal view of the cheek support apparatus.
Figure 4:
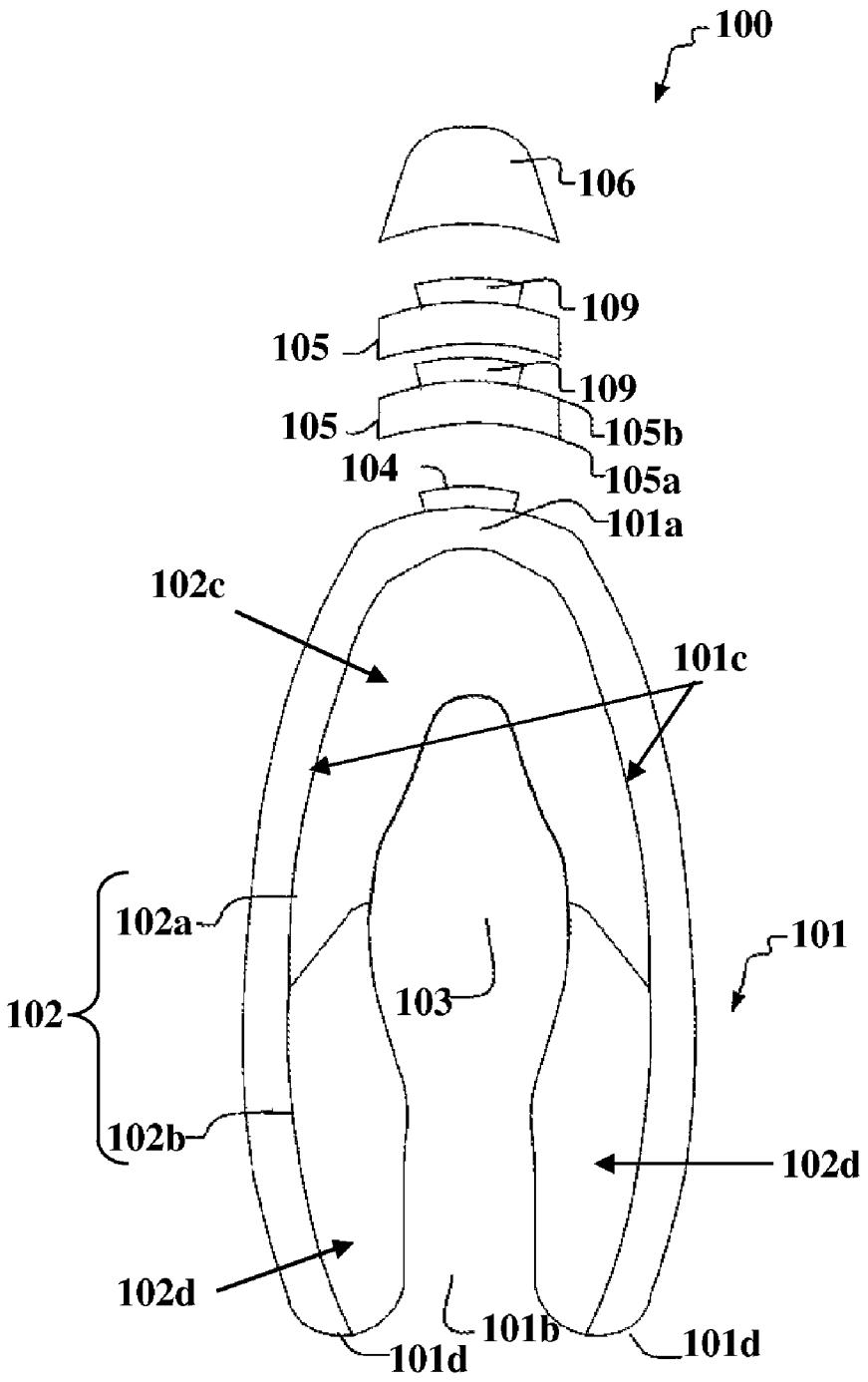
FIG. 4 exemplarily illustrates a rear orthogonal view of the cheek support apparatus.

FIG. 3 and FIG. 4 exemplarily illustrate a front orthogonal view and a rear orthogonal view of the cheek support apparatus 100 respectively. The cheek support apparatus 100 disclosed herein comprises the shell member 101, the base member 104, one or more shim members 105, and the cheek supporting member 106 as disclosed in the detailed description of FIG. 1 and FIGS. 2A-2B. The shell member 101 has a closed upper end 101*a* and an open lower end 101*b*. The shell member 101 comprises an inner frictional surface 102. The inner frictional surface 102 defines an opening 103 between the closed upper end 101*a* and the open lower end 101*b* of the shell member 101 for accommodating the stock 107*a* of the firearm 107. The inner frictional surface 102 comprises a first section 102*a* made of a high friction compressible material 102*c* and second sections 102*b* made of a low friction material 102*d*. The combination of the low friction material 102*d* and the high friction compressible material 102*c* provides ease of installation of the cheek support apparatus 100 on the stock 107*a* of the firearm 107 and provides resistance to recoil-induced slippage of the cheek support apparatus 100 from the stock 107*a* of the firearm 107. The base member 104 configured as a key member is rigidly attached on the closed upper end 101*a* of the shell member 101. The shim members 105 configured with slots 108 and key members 109 are removably attached on the rigidly attached base member 104 for adjustably positioning the cheek supporting member 106 on the base member 104.

Figure 5A:
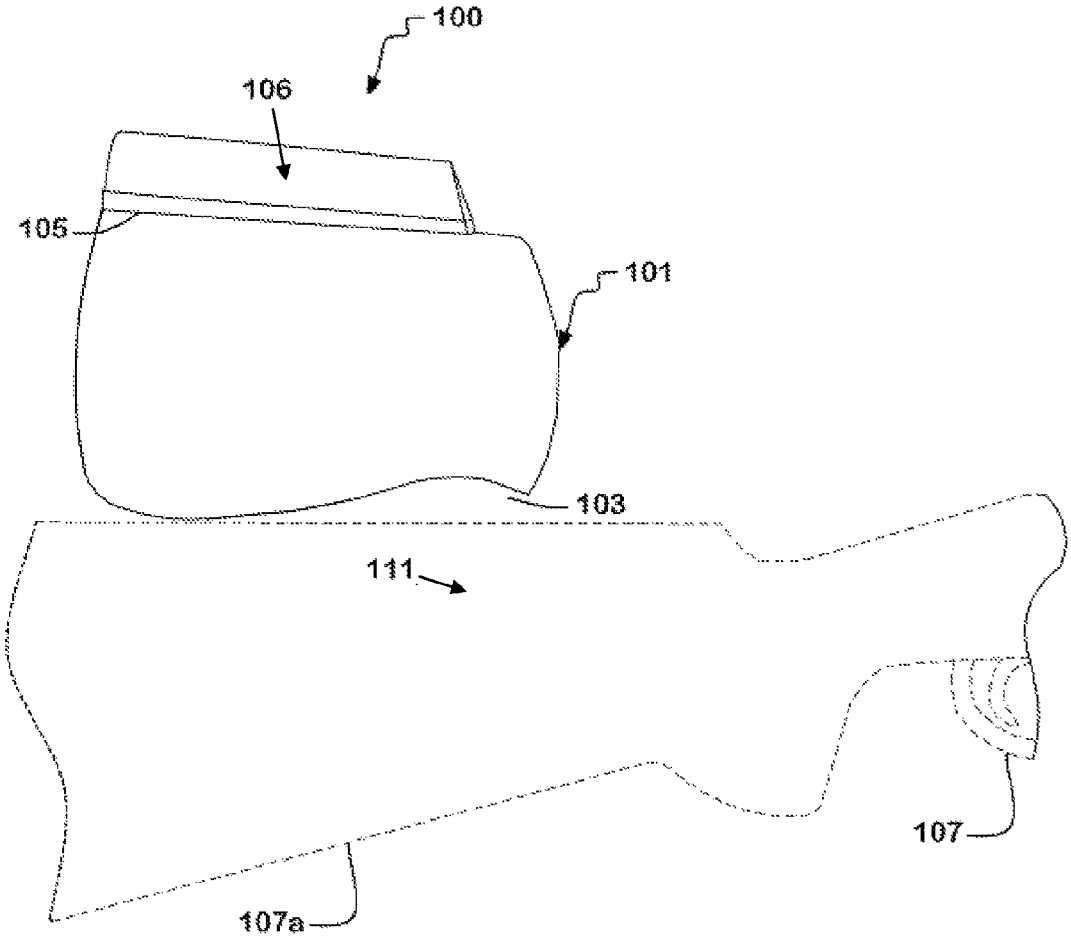
FIGS. 5A-5B exemplarily illustrate installation of the cheek support apparatus on a stock of a firearm.
Figure 5B:
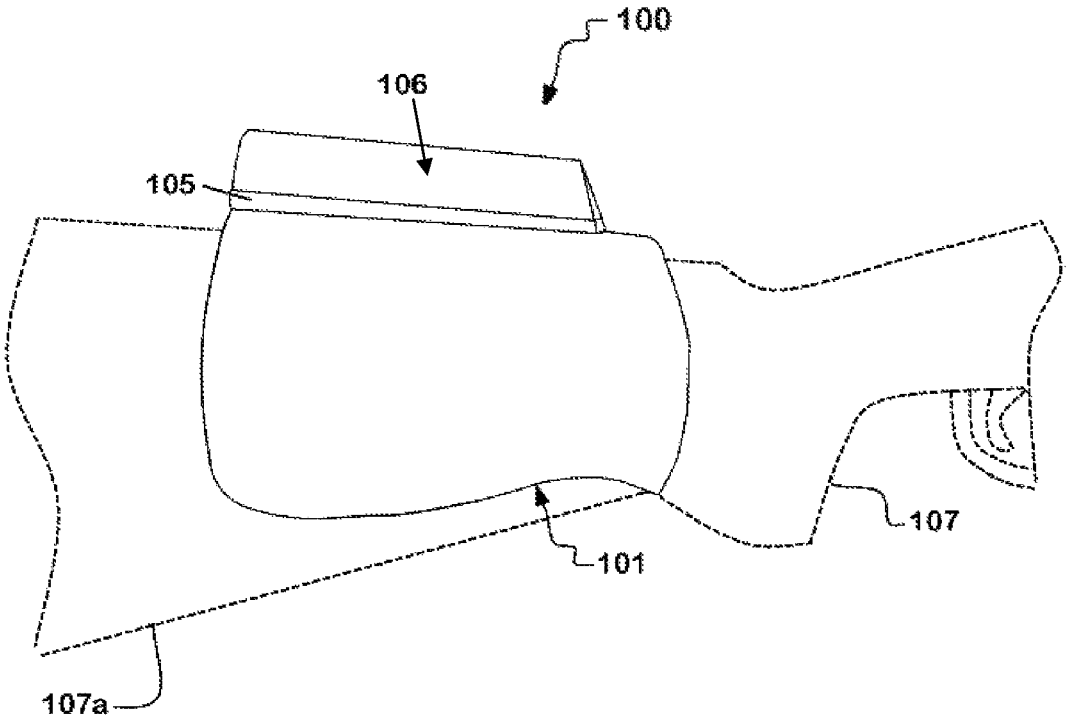

FIGS. 5A-5B exemplarily illustrate installation of the cheek support apparatus 100 on a stock 107*a* of a firearm 107. To install the cheek support apparatus 100 on the stock 107*a* of the firearm 107, the user holds the shell member 101 and positions the opening 103 defined by the inner frictional surface 102 of the shell member 101 over the comb 111 of the stock 107*a* as exemplarily illustrated in FIG. 5A. The user then presses the shell member 101 on the stock 107*a* to conform the shell member 101 to the contours of the stock 107*a* as exemplarily illustrated in FIG. 5B. The cheek support apparatus' 100 resistance to rearward movement due to friction between the shell member 101 and the stock 107*a* is a function of the area of the shell member 101 that stays in contact with the stock 107*a*, the coefficient of friction of that contact area, and the direction in which the recoil force acts on the cheek support apparatus 100. The friction is maximized in the direction of recoil due to the large surface area of the high friction compressible material 102*c* of the inner frictional surface 102 that is oriented in the same direction as the axis of the recoil. The surface of the stock 107*a* and the area of the inner frictional surface 102 covered with the high friction compressible material 102*c* are pressed together with minimal sliding.

In an embodiment, the shell member 101 of the cheek support apparatus 100 is softened by heat and then positioned on top of the comb 111 of the stock 107*a* with its line of symmetry above the comb's 111 line of symmetry. The shell member 101 is pushed down and bent until the shell member 101 is closely contoured to the stock 107*a*. When the material of the shell member 101 cools, the material rigidly contacts the stock 107*a*. If the stock 107*a* is not symmetric, the shell member 101 is positioned on top of the comb 111 of the stock 107*a* with its line of symmetry above the comb's 111 line of symmetry. The change in height of the comb 111 is accomplished by leaving a void between the two lines of symmetry during fabrication or by attaching a cheek supporting member 106 to the closed upper end 101*a* of the shell member 101. The height of the cheek support apparatus 100 can be adjusted by engageably connecting one or more shim members 105 to the base member 104 and then attaching the cheek supporting member 106 to the upper most shim member 105. The height of the cheek supporting member 106 and the shim member 105 on the shell member 101 can be varied based on a user's preferences. The surface of the cheek supporting member 106 can be made of any suitable material for the user's comfort. The shim members 105 and the cheek supporting member 106 can be removed from the cheek support apparatus 100 without removing the shell member 101 from the stock 107*a* of the firearm 107, thereby reducing the surface wear on the stock 107*a* of the firearm 107.

Figure 6:
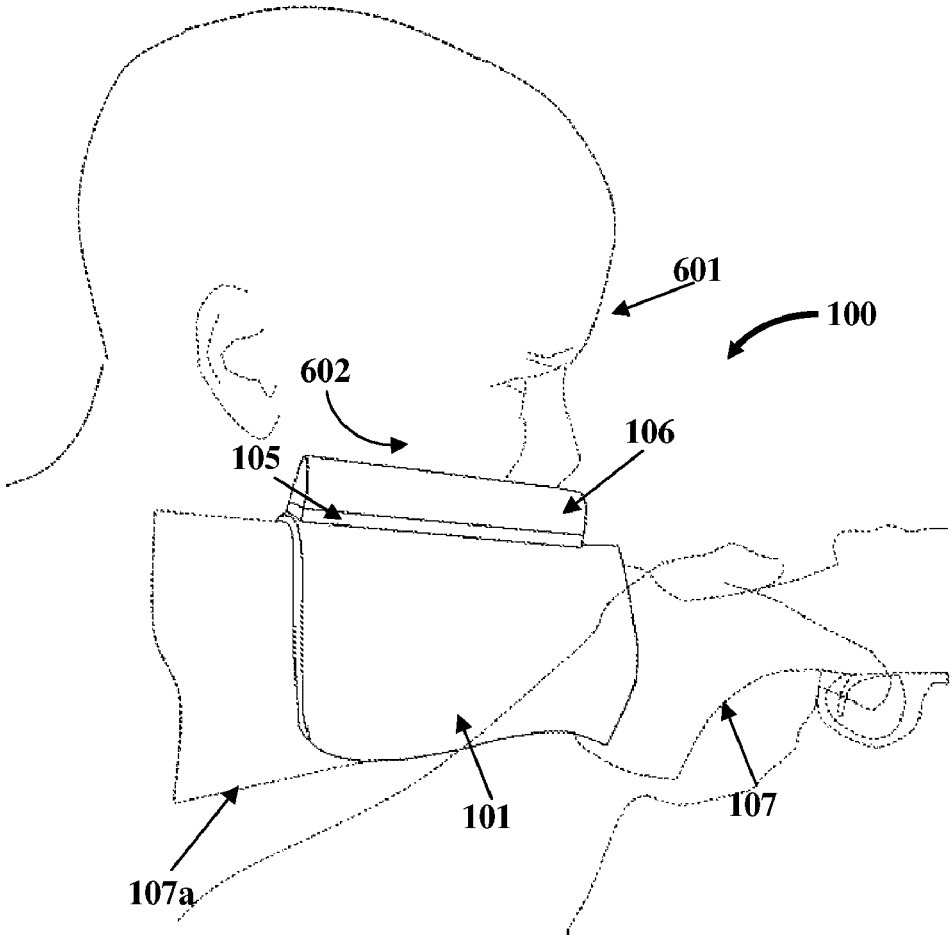
FIG. 6 exemplarily illustrates a position of a user with a cheek resting against a cheek supporting member of the cheek support apparatus.

FIG. 6 exemplarily illustrates a position of a user 601 with the user's 601 cheek 602 resting against the cheek supporting member 106 of the cheek support apparatus 100. In order to control recoil of a firearm 107, the user 601 rests a cheek 602 on the firearm's 107 comb 111. To simultaneously control recoil and see through the center of the riflescope, the firearm's 107 comb 111 must be at an appropriate height for resting the user's 601 cheek 602. The preferred comb height is achieved by using the shim members 105 along with the cheek supporting member 106 on the shell member 101 of the cheek support apparatus 100. The user 601 adjusts the position of the cheek supporting member 106 on the firearm's 107 comb 111 using one or more shim members 105. Based on the position of the user 601, the user 601 removably attaches the cheek supporting member 106 to either the base member 104 or a shim member 105 as disclosed in the detailed description of FIGS. 1-4. After adjusting the position of the cheek supporting member 106, the user 601 rests a cheek 602 against the cheek supporting member 106. By resting the cheek 602 against the height adjusted cheek support member 106, the user 601 simultaneously controls recoil and sees through the center of the riflescope.

Figure 7:
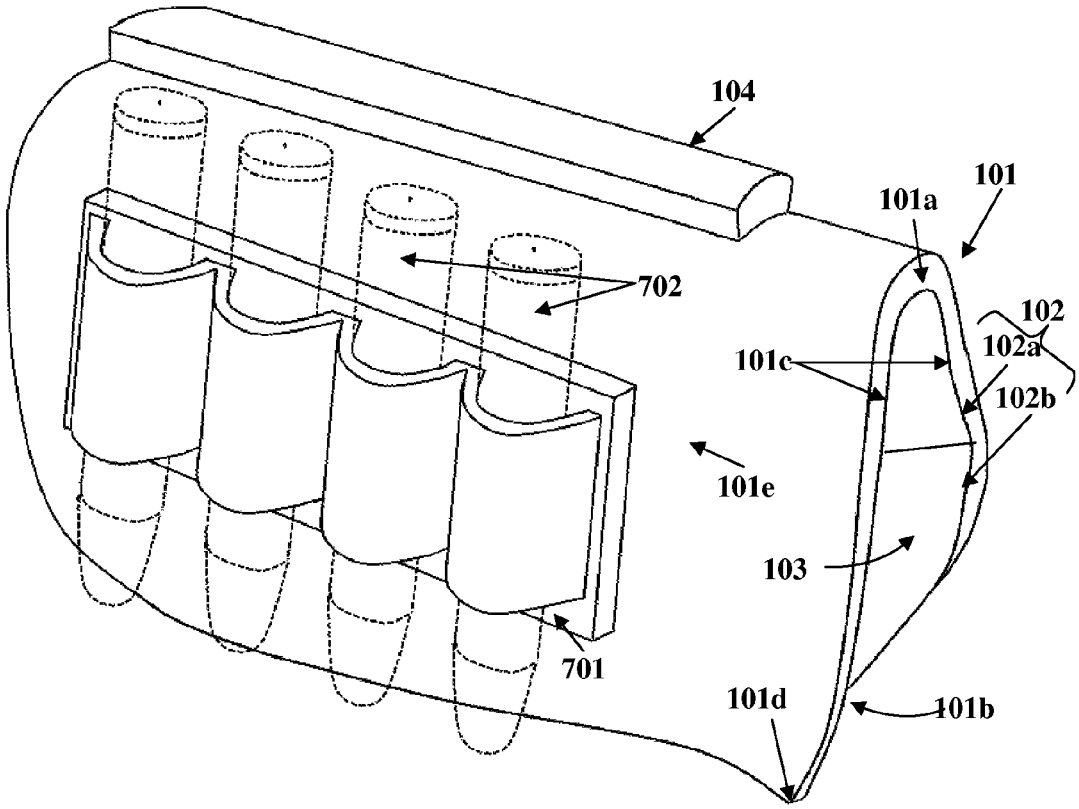
FIG. 7 exemplarily illustrates an auxiliary element detachably attached on the cheek support apparatus for accommodating multiple items associated with a firearm.

FIG. 7 exemplarily illustrates an auxiliary element 701 detachably attached on the cheek support apparatus 100 for accommodating multiple items 702 associated with a firearm 107. In an embodiment, one or more auxiliary elements 701 are detachably attached on the cheek support apparatus 100 for accommodating multiple items 702 associated with the firearm 107. For example, auxiliary elements 701 such as cartridge loops or other attachments are detachably attached on the opposing sides 101*c* on the outer surface 101*e* of the shell member 101 for accommodating ammunition or other items 702. By installing cartridge loops or other attachments on the opposing sides 101*c* of the cheek support apparatus 100, the cheek support apparatus 100 serves as a portable device to carry ammunition or other armament related items 702.

Figure 8:
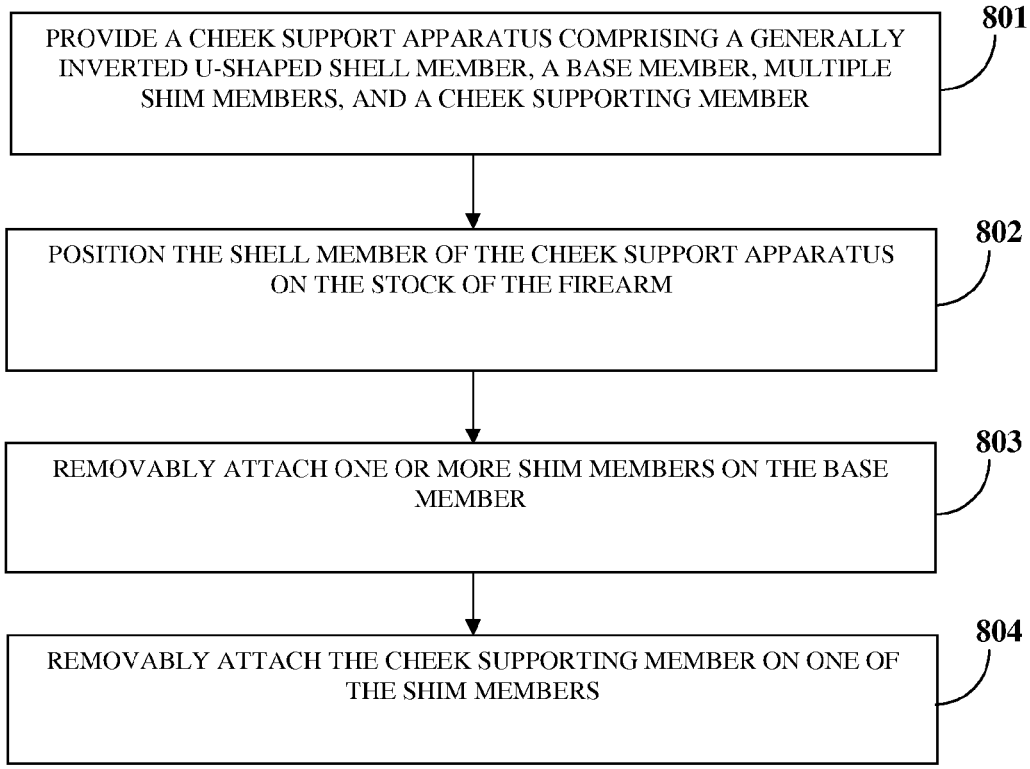
FIG. 8 illustrates a method for detachably attaching the cheek support apparatus on a stock of a firearm.

FIG. 8 illustrates a method for detachably attaching the cheek support apparatus 100 on a stock 107*a* of a firearm 107. The cheek support apparatus 100 comprising the shell member 101, the base member 104, the shim members 105, and the cheek supporting member 106 as disclosed in the detailed description of FIG. 1 and FIGS. 2A-2B, is provided 801. The shell member 101 of the cheek support apparatus 100 disclosed herein is positioned 802 on the stock 107*a* of the firearm 107 for accommodating the stock 107*a* of the firearm 107 within the opening 103 as exemplarily illustrated in FIGS. 5A-5B. The form fitting material of the shell member 101 conforms to the contours of the stock 107*a* of the firearm 107. The inner frictional surface 102 of the shell member 101 rigidly contacts the stock 107*a* of the firearm 107 and restricts movement of the shell member 101 on the stock 107*a* of the firearm 107. The shell member 101 comprises a first section 102*a* made of a high friction compressible material 102*c*, and second sections 102*b* made of a low friction material 102*d*. The high friction compressible material 102*c* of the first section 102*a* of the inner frictional surface 102 of the shell member 101 rigidly contacts the stock 107*a* of the firearm 107 and restricts movement of the shell member 101 on the stock 107*a* of the firearm 107. The low friction material 102*d* of each of the second sections 102*b* of the inner frictional surface 102 of the shell member 101 enables slidable movement of the shell member 101 on the stock 107*a* of the firearm 107.

In an embodiment, one or more shim members 105 are removably attached 803 on the rigidly attached base member 104 for adjustably positioning the cheek supporting member 106 of the cheek support apparatus 100 on the rigidly attached base member 104. One of the shim members 105 is removably attached to the rigidly attached base member 104 by engageably connecting the slot 108 of that shim member 105 to the rigidly attached base member 104. One of the shim members 105 is removably attached to another one of the shim members 105 by engageably connecting the slot 108 of that shim member 105 to the key member 109 of the other shim member 105. The cheek supporting member 106 for supporting the user's 601 cheek 602 is removably attached 804 on one of the shim members 105. The cheek supporting member 106 is removably attached to one of the shim members 105 by engageably connecting a slot 110 configured on the cheek supporting member 106 to the key member 109 of that shim member 105. In an embodiment, when a comfortable height is achieved without the shim members 105, the cheek supporting member 106 can be directly connected to the base member 104.

Figure 9:
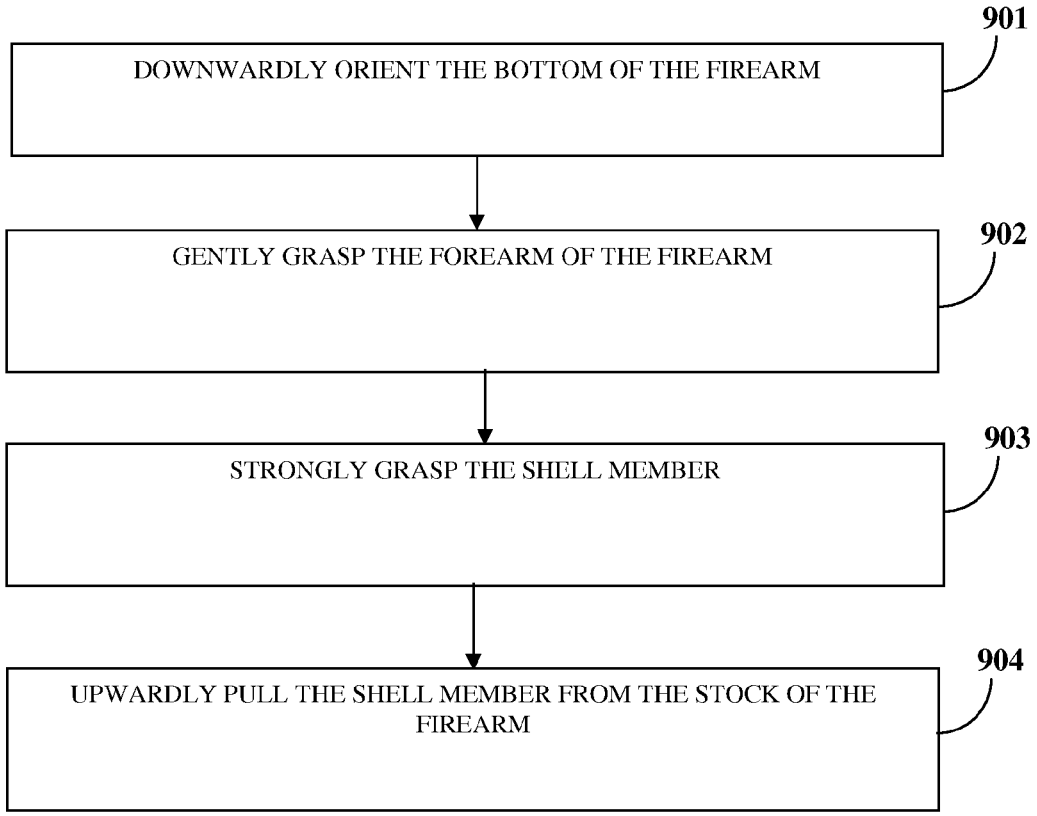
FIG. 9 exemplarily illustrates a method for removing the cheek support apparatus from the stock of the firearm.

FIG. 9 exemplarily illustrates a method for removing a cheek support apparatus 100 from the stock 107*a* of the firearm 107. A user 601 downwardly orients 901 the bottom of the firearm 107. The user 601 then gently grasps 902 the forearm of the firearm 107 and strongly grasps 903 the shell member 101 of the cheek support apparatus 100. The user 601 then upwardly pulls 904 the shell member 101 from the stock 107*a* of the firearm 107 to remove the cheek support apparatus 100 from the stock 107*a* of the firearm 107.

Consider an example where a user 601 uses the cheek support apparatus 100 disclosed herein attached to a firearm 107. The user 601 uses the cheek support apparatus 100 to allow easy access to the firearm 107 for cleaning with no modification to the stock 107*a* and to control recoil of the firearm 107 during firing of the firearm 107. To use the cheek support apparatus 100 disclosed herein, the user 601 positions the opening 103 of the shell member 101 on the stock 107*a* of the firearm 107 and pushes the cheek support apparatus 100 towards the stock 107*a* of the firearm 107. As the inner frictional surface 102 of the shell member 101 comes in contact with the stock 107*a* of the firearm 107, the user 601 moves the shell member 101 forward and then rearward to match the contours of the stock 107*a*. The inner frictional surface 102 is compressed by the clamping force of the shell member 101. The inner frictional surface 102 comprises high friction compressible material 102*c*, for example, rubber, polyurethane foam, etc., and low friction material 102*d*. To install the cheek supporting member 106, the slot 108 of one of the shim members 105 is inserted into the base member 104 by pushing the slot 108 over the base member 104. If the height obtained by inserting the shim member 105 is sufficient for the user 601, the user 601 attaches the cheek supporting member 106 onto the key member 109 extending along the upper surface 105*b* of the shim member 105. The user 601 can then rest a cheek 602 on the cheek supporting member 106, for example, during firing of the firearm 107. If the height obtained by inserting the shim member 105 is not sufficient for the user 601, the user 601 removes the cheek supporting member 106, installs a second shim member 105 over the first shim member 105, and then reinstalls the cheek supporting member 106 on the second shim member 105.

The user 601 can also remove the cheek supporting member 106 to allow access to the barrel of the firearm 107 for cleaning the barrel using a cleaning rod. The user 601 may clean the barrel of the firearm 107 by removing the cheek support apparatus 100 from the stock 107*a* of the firearm 107 or by only removing the cheek supporting member 106 and the shim members 105 from the shell member 101. To remove the cheek support apparatus 100 from the stock 107*a* of the firearm 107, the user 601 orients the bottom of the firearm 107 downwardly and grasps the forearm of the firearm 107 gently. The user 601 then strongly grasps the shell member 101 and upwardly pulls the shell member 101 from the stock 107*a* of the firearm 107. The user 601 removes the cheek supporting member 106 and the shim members 105 from the shell member 101 by disengaging the cheek supporting member 106 from the shim member 105 and then disengaging the shim member 105 from the base member 104. If the cheek supporting member 106 is directly connected the base member 104, the user 601 disengages the cheek supporting member 106 from the base member 104.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A cheek support apparatus for a firearm, comprising:

a generally inverted U-shaped shell member made of a form fitting material configured to conform to contours of a stock of said firearm, said generally inverted U-shaped shell member having a closed upper end and an open lower end;

said generally inverted U-shaped shell member comprising an inner frictional surface, wherein said inner frictional surface of said generally inverted U-shaped shell member defines an opening between said closed upper end and said open lower end for accommodating said stock of said firearm, wherein said inner frictional surface of said generally inverted U-shaped shell member rigidly contacts said stock of said firearm and restricts movement of said generally inverted U-shaped shell member on said stock of said firearm;

a base member rigidly attached on said closed upper end of said generally inverted U-shaped shell member;

a cheek supporting member removably attached on said base member for supporting a cheek of a user; and one or more shim members removably attached on said base member for adjustably positioning said cheek supporting member on said base member, wherein each of said one or more shim members comprises a slot longitudinally extending along a lower surface of said each of said one or more shim members, and a key member extending along an upper surface of said each of said one or more shim members, wherein said slot of one of said one or more shim members is configured to engageably connect to said base member, and wherein said key member of said one of said one or more shim members is configured to engageably connect to one of said slot of another one of said one or more shim members and a slot configured on said cheek supporting member;

whereby said cheek support apparatus supports said cheek of said user during recoil of said firearm.

2. The cheek support apparatus of claim 1, wherein said inner frictional surface is selectively configured with different coefficients of friction to enable said rigid contact of said generally inverted U-shaped shell member to 1 said stock of said firearm.

3. The cheek support apparatus of claim 1, wherein said inner frictional surface comprises a first section and second sections, wherein said first section proximally extending from said open lower end on opposing sides of said generally inverted U-shaped shell member towards said closed upper end is made of a high friction compressible material, and wherein each of said second sections extending from said open lower end on said opposing sides of said generally inverted U-shaped shell member towards said first section is made of a low friction material.

4. The cheek support apparatus of claim 1, wherein said base member is configured as a key member that engageably connects to one of said slot of said one of said one or more shim members, and said slot configured on said cheek supporting member.

5. The cheek support apparatus of claim 1, wherein said slot configured on said cheek supporting member longitudinally extends along a base of said cheek supporting member, wherein said slot of said cheek supporting member is configured to engageably connect to one of said key member of one of said one or more shim members and said base member.

6. The cheek support apparatus of claim 1, wherein said form fitting material of said generally inverted U-shaped shell member is a thermoplastic material.

7. The cheek support apparatus of claim 1, further comprising one or more auxiliary elements detachably attached on said cheek support apparatus for accommodating a plurality of items associated with said firearm.

8. A method for detachably attaching a cheek support apparatus on a stock of a firearm, comprising:

providing said cheek support apparatus comprising:

a generally inverted U-shaped shell member made of a form fitting material configured to conform to contours of said stock of said firearm, said generally inverted U-shaped shell member having a closed upper end and an open lower end;

said generally inverted U-shaped shell member comprising an inner frictional surface, wherein said inner frictional surface of said generally inverted U-shaped shell member defines an opening between said closed upper end and said open lower end for accommodating said stock of said firearm, wherein said inner frictional surface is selectively configured with different coefficients of friction to enable rigid contact of said generally inverted U-shaped shell member to said stock of said firearm;

a base member rigidly attached on said closed upper end of said generally inverted U-shaped shell member;

a cheek supporting member removably attachable on said rigidly attached base member; and one or more shim members removably attached on said rigidly attached base member, wherein each of said one or more shim members comprises a slot longitudinally extending along a lower surface of said each of said one or more shim members, and a key member extending along an upper surface of said each of said one or more members;

positioning said generally inverted U-shaped shell member of said cheek support apparatus on said stock of said firearm for accommodating said stock of said firearm within said opening, wherein said form fitting material of said generally inverted U-shaped shell member conforms to said contours of said stock of said firearm, wherein said inner frictional surface of said generally inverted U-shaped shell member rigidly contacts said stock of said firearm and restricts movement of said generally inverted U-shaped shell member on said stock of said firearm; and removably attaching said cheek supporting member on said rigidly attached base member for supporting a cheek of a user.

9. The method of claim 8, wherein said inner frictional surface comprises a first section and second sections, wherein said first section proximally extending from said open lower end on opposing sides of said generally inverted U-shaped shell member towards said closed upper end is made of a high friction compressible material, and wherein each of said second sections extending from said open lower end on said opposing sides of said generally inverted U-shaped shell member towards said first section is made of a low friction material.

10. The method of claim 9, wherein said high friction compressible material of said first section of said inner frictional surface of said generally inverted U-shaped shell member rigidly contacts said stock of said firearm and restricts movement of said generally inverted U-shaped shell member on said stock of said firearm.

11. The method of claim 9, wherein said low friction material of said each of said second sections of said inner frictional surface of said generally inverted U-shaped shell member enables slidable movement of said generally inverted 1 U-shaped shell member on said stock of said firearm.

12. The method of claim 8, further comprising removably attaching one or more of said one or more shim members on said rigidly attached base member of said cheek support apparatus for adjustably positioning said cheek supporting member of said cheek support apparatus on said rigidly attached base member.

13. The method of claim 8, wherein one of said one or more shim members is removably attached to said rigidly attached base member by engageably connecting said slot of said one of said one or more shim members to said rigidly attached base member.

14. The method of claim 8, wherein one of said one or more shim members is removably attached to another one of said one or more shim members by engageably connecting said slot of said one of said one or more shim members to said key member of said another one of said one or more shim members.

15. The method of claim 8, wherein said cheek supporting member is removably attached to one of said one or more shim members by engageably connecting a slot configured on a base of said cheek supporting member to said key member of said one of said one or more shim members.

* * * * *